United States Patent [19]

Christophersen

[11] 4,304,195

[45] Dec. 8, 1981

[54] HEAD GATE FOR PEN CONFINING STRUCTURE

[76] Inventor: Ben B. Christophersen, 31313 - 124th SE., Auburn, Wash. 98033

[21] Appl. No.: 137,241

[22] Filed: Apr. 4, 1980

[51] Int. Cl.[3] ..... A61D 3/00

[52] U.S. Cl. ..... 119/99

[58] Field of Search ..... 119/98, 99, 147 R, 149, 119/150

[56] References Cited

U.S. PATENT DOCUMENTS

| | | | |
|---|---|---|---|
| 2,099,956 | 11/1937 | Flatley | 119/98 |
| 2,801,612 | 8/1957 | McMurray et al. | 119/98 |
| 3,128,746 | 4/1964 | Farr | 119/98 X |
| 3,239,875 | 3/1966 | Hensgen et al. | 119/99 X |
| 3,691,998 | 9/1972 | Luinstra | 119/98 |

*Primary Examiner*—Gene Mancene
*Assistant Examiner*—Robert P. Swiatek
*Attorney, Agent, or Firm*—Kenneth S. Kessler

[57] ABSTRACT

A head gate for pen confining structures is disclosed. The head gate utilizes two synchronized gates with a gap there between. When the animal enters the gate, the gap is lodged in its open position. As the animal moves forward, the neck of the animal fits between the gap of the closing gates and rotates the gates forward and shuts. After the gates have closed, the animal cannot remove his head for the gates are held in position by a stop mechanism.

4 Claims, 2 Drawing Figures

HEAD GATE FOR PEN CONFINING STRUCTURE

BACKGROUND OF THE INVENTION

The head gate of the present invention utilizes the movement of the animal itself in conjunction with the synchronized swing of opposing parts of gates to hold the head of an animal in place. A number of U.S. Patents have addressed the question of animal catching.

In the McDonough U.S. Pat. No. 3,720,187 an animal catching gate utilizing an upstanding frame having opposite sides is disclosed. However, in the McDonough Patent the operator must necessarily operate the animal catching gate with precision. Thus, the operator must close the gate at just the proper time in order to properly secure the neck of the animal. Thus, there necessarily becomes an element of skill in the use of the gate. In the present invention, the animal itself effectively closes the gates with his neck and head in position, for the shoulders of the animal push the gate closed as the animal proceeds forward.

In the Roark U.S. Pat. No. 4,059,073 a multi-action head gate is disclosed which selectively opens the passageway or closes it about the neck of an animal. The apparatus utilizes a vertically movable ear block and a pair of opposing pivotable jaw locks. Thus, when the gate is placed in position, the head of the animal is placed in a definite set position.

In the present invention, the animal's head is swung from the left to the right about the two opposing gates. Said definite advantages for the user when swinging the animal's head to either the left or right thereby exposes certain blood vessels which are advantageous in the giving of shots and other medical treatments.

The present invention utilizes a minimum of moving parts. Further, the operator has the advantage of being able to handle the pen solely by himself. Thus, when the operator wishes to have the animal leave the pen, he merely depresses the release lever and pulls back on the draw bar handle and thereby causes an exit route for the animal.

DETAILED DESCRIPTION OF THE DRAWINGS

Figure 1:
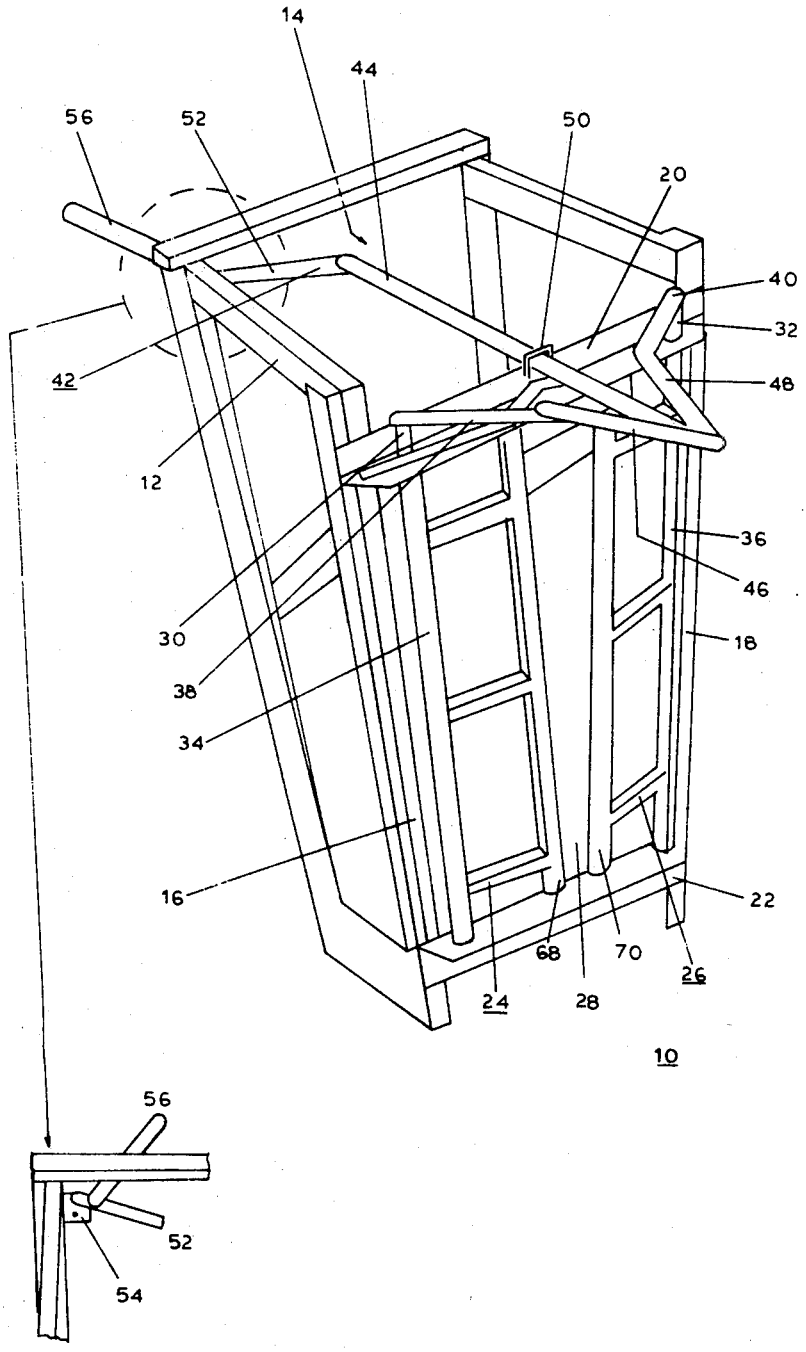
FIG. 1 is an overhead perspective view of the head gate.

An overhead perspective view of the head gate 10 in a closed position is illustrated in FIG. 1. The heat gate 10 is attached to the front end of a pen confining structure 12. The pen confining structure 12 has a rear opening 14 which allows the animal to move into the pen confining structure 12.

The head gate 10 has two side rails 16 and 18. The side rails 16 and 18 are secured to the pen confining structure 12. The side rails 16 and 18 rise vertically.

Affixed horizontally to the side rails 16 and 18 are the upper and lower rails 20 and 22. The upper rail 20 is positioned at the upper limit of the head gate 10 while the lower rail 22 is positioned at the lower limit of the head gate 10.

Running parallel and close to the side rails 16 and 18 are the left gate 24 and right gate 26 respectively. Between the left gate 24 and right gate 26 is gap 28 which permits an animal to stick his head between the left and right gates 24 and 26 while in the open position. However, the gap is not sufficiently wide to allow the animal to pull its head rearward when the gates are in the closed position.

Passing vertically between the upper rail 20 and lower rail 22 are left and right pivot rods 30 and 32. Surrounding the left pivot rod 30 is left gate hollow cylinder 34. The left gate hollow cylinder 34 is secured to the left pivot rod 30 so that when the pivot rod 30 rotates the left gate hollow cylinder 34 also rotates. Thus, the rotation of the left pivot rod 30 can cause the opening and closing of the left gate 24. Positioned in the same relationship on the right side of the head gate 10 is right pivot rod 32. Surrounding the right pivot rod 32 is the right gate hollow cylinder 36. Similar to the left gate hollow cylinder 34 the right gate 26 opens and closes according to the rotation of the right pivot rod 32.

Secured to the upper end of the left pivot rod 30 is the left crank lever 38. Also, secured to the upper end of the right pivot rod 32 is the right crank lever 40. Thus, the rotation of the left and right crank levers 38 and 40 produces a corresponding rotation in the left and right pivot rods 30 and 32.

A push-pull mechanism 42 operates the left and right crank levers 38 and 40. The push-pull mechanism 42 as set forth in FIG. 1 can be operated from the rear of the pen confining structure 12.

Passing from the rear of the pen confining structure 12 and over the upper rail 20 is draw bar 44. The forward end of the draw bar 44 is connected to the left and right crank levers 38 and 40 by left and right scissor links 46 and 48. The scissor links 46 and 48 transfer the forward and rearward movement of the draw bar 44 to the left and right crank levers 38 and 40 and due to their configuration, the scissors are able to combine with the crank levers to transfer the forward-rearward movement such that the crank levers rotate. Thus, when the draw bar is thrust forward the left crank lever rotates clockwise and the right crank lever rotates counterclockwise. Conversely, when the draw bar is drawn rearward, the left crank lever rotates counterclockwise and the right crank lever rotates clockwise. The draw bar 44 is kept equidistant between the left and right pivot bars by the draw bar guide 50.

Affixed to the rear of the draw bar 44 is draw bar rear scissor arm 52. The draw bar rear scissor arm 52 passes from the draw bar 44 to the scissor arm support platform 54. The scissor arm support platform holds the draw bar scissor arm 52 and the draw bar 44 at a given height.

Affixed to the draw bar scissor arm 52 is handle 56. When the operator pulls the handle 56 towards himself, the handle causes a pivoting of the draw bar scissor arm 52 which in turn pulls the draw bar 44 to the rear.

Figure 2:
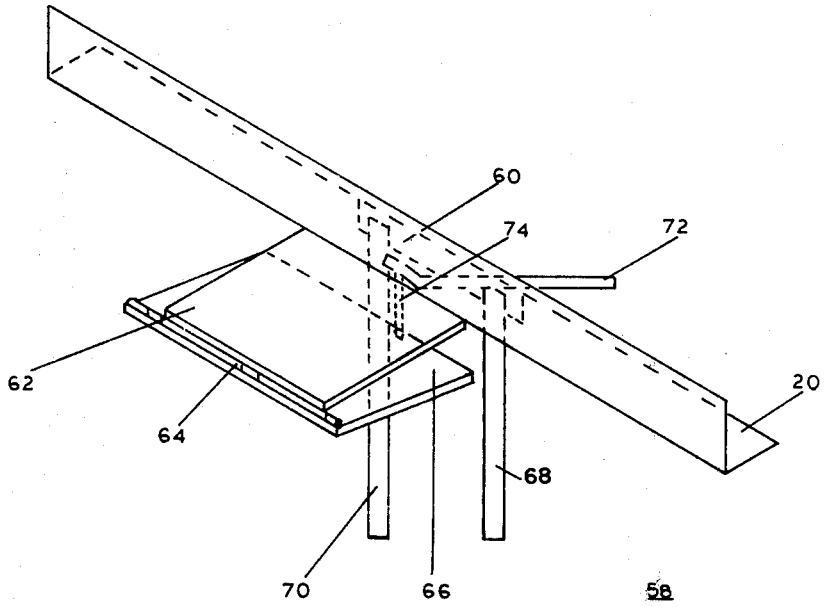
FIG. 2 is a perspective view of the stop mechanism.

In FIG. 2 a perspective view of the stop mechanism 58 is disclosed. The method for stopping the forward movement of the left and right gates 24 and 26 is stop bar 60. The stop bar 60 extends beneath the upper rail 20 and is sufficiently strong to comprise an abutment to the forward moving left and right gates 24 and 26.

One of the primary objective of the present invention is to allow an animal to push the gates forward when entering the pen confining structure, but once the animal has pushed the gates against the stop bar 60, not to allow the animal to pull the gates rearward. The stop mechanism 58 accomplishes these objectives.

Extending rearward and horizontal to the upper rail 20 is hinge support platform 62. Affixed to the rear of the hinge support platform 62 is hinge 64 which in turn is affixed to hinge stop plate 66. To better illustrate the workings of the hinge stop plate 66 let us follow the progress of an animal entering the pen confining structure 12. Plate 62 is narrower than plate 66 allowing the bars to protrude upwardly to contact horizontal stop bar 60 yet still be restricted by plate 66.

When the animal enters the pen 12 the gates 24 and 26 are in an open position with the left and right gate inner vertical rails 68 and 70 behind the hinge support platform 62. However, as the animal pushes forward the left and right gate inner vertical rails also move forward eventually coming into contact with the hinge stop plate 66. Since the hinge stop plate is affixed to the permanent hinge support platform 62 by a hinge 64, the vertical rails 68 and 70 slide along the lower surface of the hinge stop plate 66.

The length of the hinge stop plate 66 is less than the distance from the hinge to the stop bar 60. Thus, the gates are pushed beyond the end of the hinge stop plate 66 and when this happens, the hinge stop plate drops down. Thus the inner vertical rails 68 and 70 are locked between the hinge stop plate 66 and stop bar 60. This prevents the backing up of the animal for the animal's head is secured between the left and right gates 24 and 26.

If the operator wishes to release the animal, the operator depresses the release lever 72 which causes the rod 74 to rise. Since rod 74 is affixed to the hinge stop plate 66, the hinge stop plate 66 also rises. Once the hinge stop plate 66 has risen, the gates may swing rearward.

The operator may cause the rearward swing of the gates 24 and 26 by pulling the handle 56 to the left (left as designated in FIG. 1). When the handle 56 is pulled to the left, the draw bar scissor arm pivots and pulls the draw bar 44 rearward. When the draw bar 44 is pulled rearward scissor links 46 and 48 cause the movement of the left and right crank levers 38 and 40 which in turn cause the rotation of the left and right pivot rods 30 and 32. The rotation of the pivot rods 30 and 32 cause the rotation of the gates 24 and 26 rearward. Since the draw bar is equidistant between the left and right pivot rods, the gates rotate rearward at the same rate.

The gates may be closed by the operator by merely pushing the handle to the right.

Although a particular preferred embodiment of the invention has been disclosed above for illustrative purposes, it is to be understood that variations or modifications thereof which lie within the scope of the appended claims are contemplated.

SUMMARY

This device consists of two gates which can be operated by the interaction of synchronized levers and pivot rods.

As such, the invention requires that the animal's head be trapped between the gates to prevent movement. This is assured through a stop mechanism which prevents the forward movement of the animal.

I claim:

1. An animal head gate comprising:

two vertical sides;

a gate whose width is less than half the distance between the two vertical sides;

a second gate whose width is less than half the distance between the two vertical sides;

a means for rotating the first and second gates in synchronization;

a means for preventing the gates from rotating forward of the two vertical sides;

a means for locking the gates in position when the gates abut the means of preventing the gates from rotating forward;

a horizontal bar affixed between the two vertical sides near the upper limit of the two vertical sides;

a horizontal platform extending from the horizontal bar rearward;

a hinge affixed at the rear of the horizontal platform; and a plate secured to the hinge such that when pressured the plate can be lifted to abut the horizontal platform and when the pressure is released the plate drops to an angle less than 90°.

2. The animal head gate of claim 1 wherein the means for rotating the first and second gates in synchronization comprises:

a draw bar capable of forward and rearward movement;

a first rotating pivot rod positioned near the first vertical side and through the horizontal bar;

a second rotating pivot rod positioned near the second vertical side and through the horizontal bar;

a crank lever affixed to the first rotating pivot rod with the first gate affixed to the first rotating pivot rod;

a second crank lever affixed to the second rotating pivot rod with the second gate affixed to the second rotating pivot rod;

a means for transferring the forward/rearward movement of the draw bar to rotation of the first and second crank levers; and a guide aligning the draw bar midway between the first and second pivot rods.

3. The animal head gate of claim 2 wherein the means for preventing the gates from rotating forward of the two vertical sides comprises a bar beneath the horizontal bar.

4. The animal head gate of claim 3 wherein the means for transferring the forward/rearward movement of the draw bar comprises:

a first scissor link affixed at one end to the front end of the draw bar and at the other end to the first crank lever; and a second scissor link affixed at one end to the front end of the draw bar and at the other end to the second crank lever.

* * * * *